US009647395B2

(12) United States Patent
Hsu et al.

(10) Patent No.: US 9,647,395 B2
(45) Date of Patent: May 9, 2017

(54) ELECTRICAL CONNECTOR ASSEMBLY WITH IMPROVED GROUND TERMINALS

(71) Applicant: FOXCONN INTERCONNECT TECHNOLOGY LIMITED, Grand Cayman (KY)

(72) Inventors: Kuo-Chun Hsu, New Taipei (TW); Wei Zhong, Kunshan (CN); Jian-Kuang Zhu, Kunshan (CN); Chun-Sheng Li, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/222,974

(22) Filed: Jul. 29, 2016

(65) Prior Publication Data

US 2017/0033508 A1 Feb. 2, 2017

(51) Int. Cl.

| | |
|---|---|
| ***H01R 12/00*** | (2006.01) |
| ***H01R 13/6585*** | (2011.01) |
| ***H01R 13/405*** | (2006.01) |
| ***H01R 13/629*** | (2006.01) |
| ***H01R 43/02*** | (2006.01) |
| ***H01R 43/24*** | (2006.01) |

(52) U.S. Cl.
CPC ..... *H01R 13/6585* (2013.01); *H01R 13/405* (2013.01); *H01R 13/629* (2013.01); *H01R 43/02* (2013.01); *H01R 43/24* (2013.01)

(58) Field of Classification Search
CPC H01R 23/722; H01R 9/0735; H01R 23/6806; H01R 23/682
USPC ..... 439/66, 67, 71, 326
See application file for complete search history.

(56) References Cited

U.S. PATENT DOCUMENTS

| | | | | |
|---|---|---|---|---|
| 6,312,263 | B1 * | 11/2001 | Higuchi | H01R 13/2435 439/66 |
| 6,692,263 | B2 * | 2/2004 | Villain | H01R 12/7076 439/629 |
| 6,719,594 | B1 * | 4/2004 | Yuzawa | G06K 7/0021 439/66 |
| 2015/0072546 | A1 | 3/2015 | Li et al. | |

FOREIGN PATENT DOCUMENTS

| | | |
|---|---|---|
| CN | 203690614 | 10/2013 |
| TW | M493184 | 1/2015 |

* cited by examiner

*Primary Examiner* — Phuongchi T Nguyen
(74) *Attorney, Agent, or Firm* — Wei Te Chung; Ming Chieh Chang

(57) ABSTRACT

An electrical connector for high-frequency transmission comprises an elongate insulative housing including a top wall and a bottom wall opposite to each other, and a pair of end walls respectively connecting two ends thereof, and a receiving cavity surrounded thereby; a terminal assembly received in the top wall and the bottom wall respectively, and stacked in an up-to-down direction; and a metal case enclosing the insulative housing; wherein the terminal assembly includes a signal terminal group, and a ground terminal group including a first contact portion and a second contact portion, wherein the first contact portion and the second contact portion are arranged in a front-to-back direction perpendicular to both the up-to-down direction and the elongate direction, and respectively protruding into the receiving cavity.

15 Claims, 8 Drawing Sheets

ELECTRICAL CONNECTOR ASSEMBLY WITH IMPROVED GROUND TERMINALS

BACKGROUND OF THE INVENTION

1. Field of the Invention

The present invention relates to an electrical connector, more particularly to an electrical connector with improved ground terminals. This application relates to the copending applications (Ser. Nos. 07/538,832 and 09/870,846) both titled "ELECTRICAL CONNECTOR HAVING GOOD ANTI-EMI PERFORMANCE", having the same applicant, the same inventors and the same assignee with the instant application.

2. Description of Related Art

With the development of the electronic industry, the electrical connector for transmitting high frequency signal and with anti-EMI (Electro-Magnetic Interference) effect is more and more popular. This kind of electrical connector generally comprises an insulative housing, two stacked terminal modules, and a shielding member sandwiched between the two terminal modules. The insulative housing is directly injection-molded onto the two terminal modules to form an mating portion with two opposite mating surfaces. Each terminal module includes at least a terminal partly exposed upon the two mating surfaces and an insulative block injection-molded onto the at least a terminal. The shielding member is spaced from the at least a terminal by the insulative block to reach anti-EMI effect. However, with the further development of the electronic industry, the electrical connector can't keep pace with the increasingly high-frequency-transmission need, that is, the signal interference of the electrical connector becomes more serious.

Hence, an improved electrical connector is desired to overcome the above problems.

BRIEF SUMMARY OF THE INVENTION

An object of the present invention is to provide an electrical connector with an anti-EMI function because of improved grounding terminals.

In order to achieve the above-mentioned object, an electrical connector is disclosed, comprising an elongate insulative housing including a top wall and a bottom wall opposite to each other, and a pair of end walls respectively connecting two ends thereof, and a receiving cavity surrounded thereby; a terminal assembly received in the top wall and the bottom wall respectively, and stacked in an up-to-down direction; and a metal case enclosing the insulative housing; wherein the terminal assembly includes a signal terminal group, and a ground terminal group including a first contact portion and a second contact portion, wherein the first contact portion and the second contact portion are arranged in a front-to-back direction perpendicular to both the up-to-down direction and the elongate direction, and respectively protruding into the receiving cavity.

In order to achieve the above-mentioned object, an electrical connector assembly is also disclosed, comprising a receptacle connector including an insulative housing having a receiving cavity, and a terminal assembly retained in the insulative housing and stacked in a up-to-down direction, and a metal case enclosing the insulative housing; and a plug connector matching up with said receptacle connector, including a tongue matching said receiving cavity and defining two opposite mating surfaces in the up-to-down direction, and at least an engaging terminal partly exposed upon said two opposite mating surfaces, and a shielding piece disposed behind the exposed part of said at least an engaging terminal; wherein the terminal assembly includes a signal terminal group, and a ground terminal group including a first contact portion and a second contact portion, wherein the first contact portion and the second contact portion are arranged in a front-to-back direction perpendicular to the up-to-down direction and respectively protruding into the receiving cavity, wherein the second contact portion engages with said shielding piece of said plug connector.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
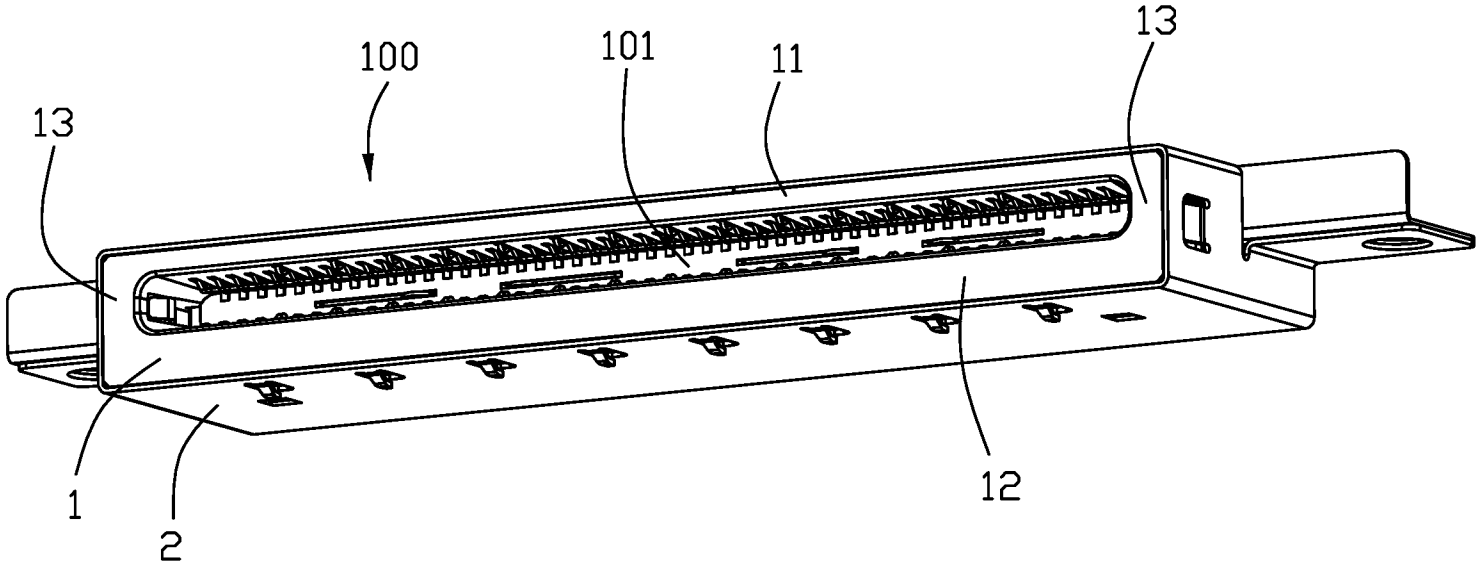
FIG. 1 is a perspective view of an electrical connector according to a first embodiment of the present invention.

Reference will be made to the drawing figures to describe the present invention in detail, wherein depicted elements are not necessarily shown to scale and wherein like or similar elements are designated by same or similar reference numeral through the several views and same or similar terminology.

Figure 2:
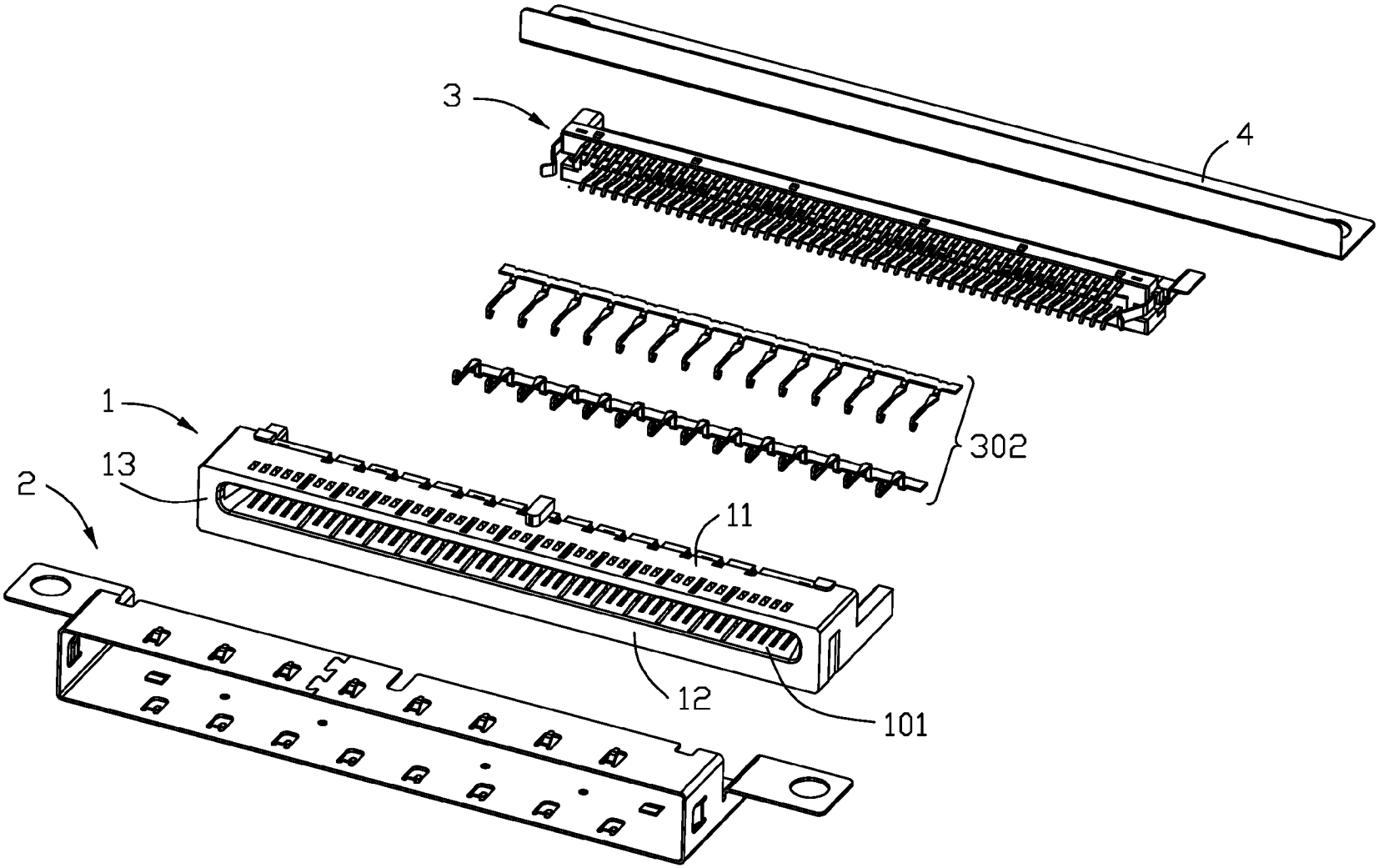
FIG. 2 is a partially exploded view of the electrical connector shown in FIG. 1.
Figure 3:
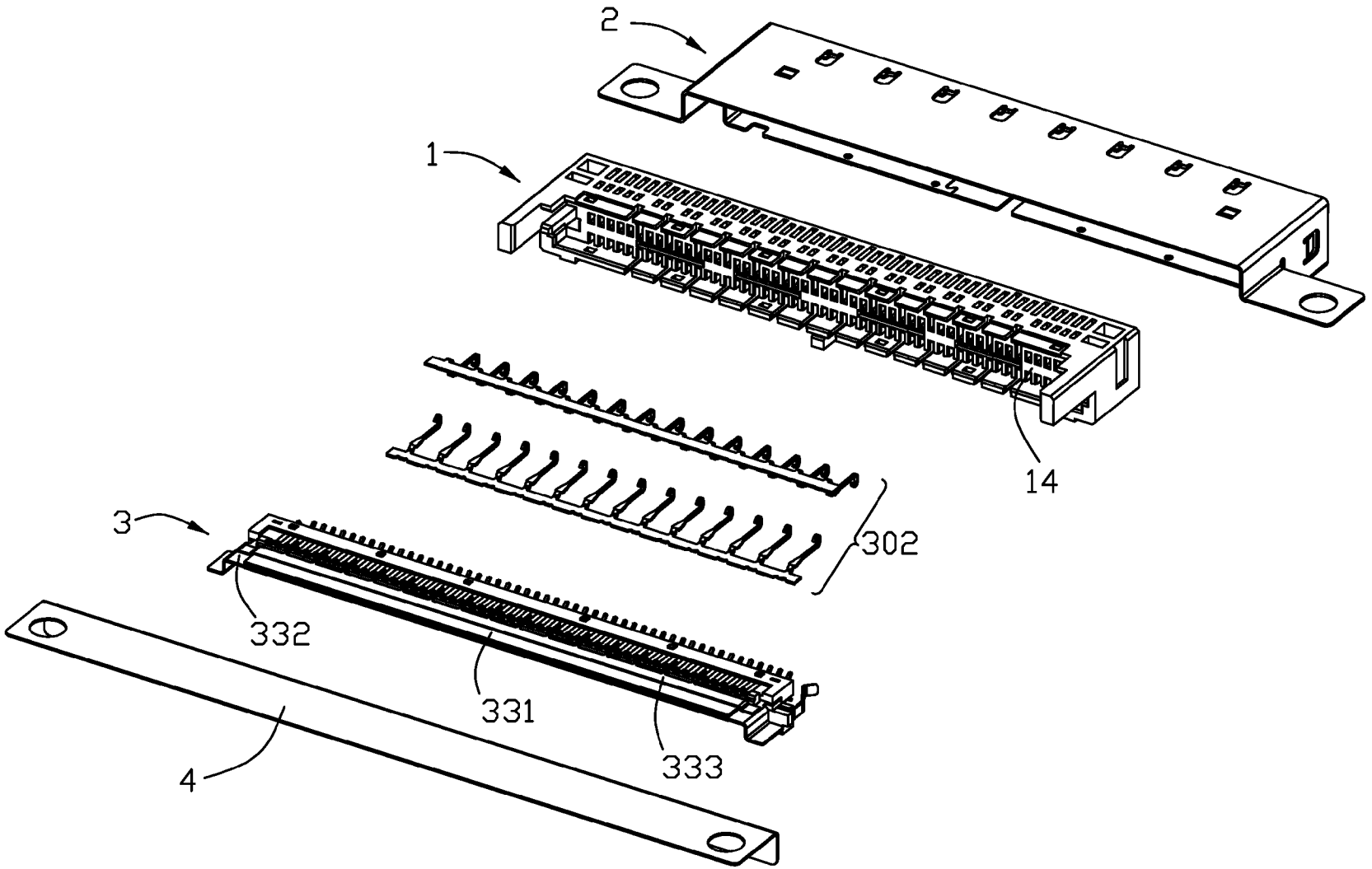
FIG. 3 is another partially exploded view of the electrical connector shown in FIG. 1.

Referring to FIGS. 1-3, according to a first embodiment of the present invention, an electrical connector 100 is adapted to be mounted on a case of an electronic device for mating with another electronic device. The electrical connector 100 comprises an elongate insulative housing 1, a metal case 2 covering the insulative housing 1, and a terminal assembly 3 assembled into the insulative housing 1. The insulative housing 1 comprises a top wall 11, a bottom wall 12 and a pair of end walls 13 connecting the top wall 11 and the bottom wall 12 respectively, which commonly rounds a receiving cavity 101.

Figure 4:
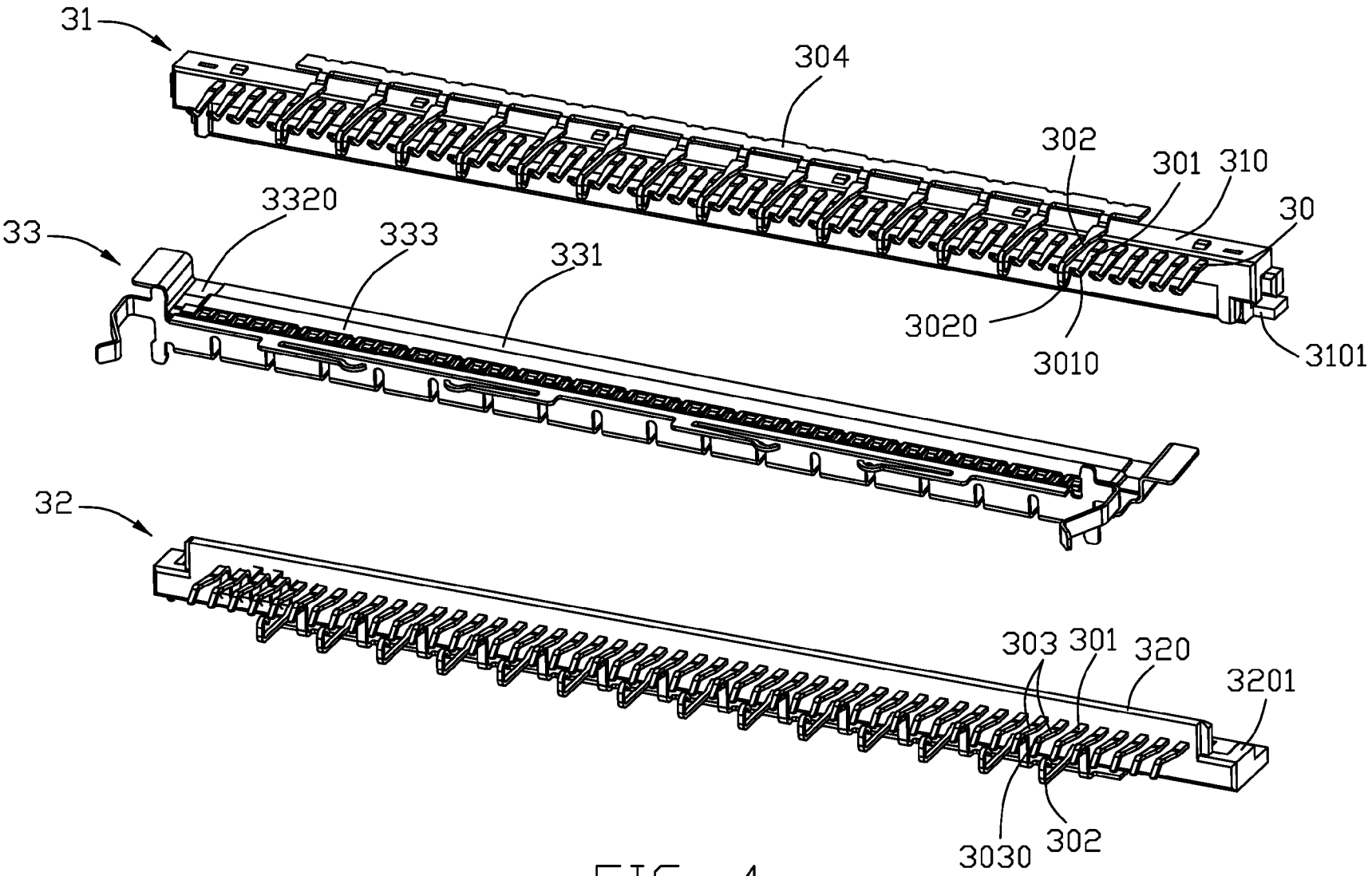
FIG. 4 is a partially exploded view of a terminal assembly of the electrical connector shown in FIG. 2.
Figure 5:
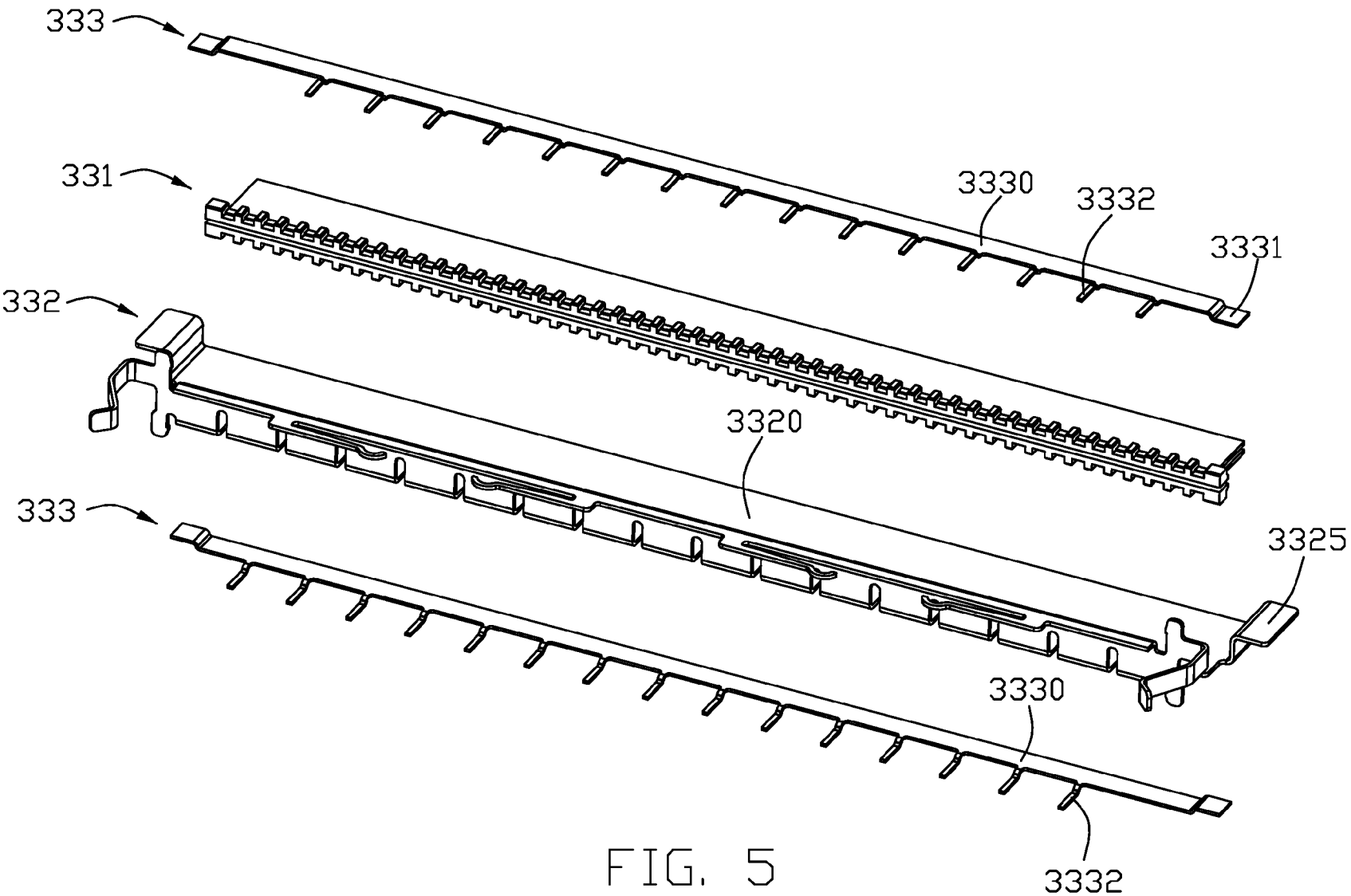
FIG. 5 is an exploded view of a third terminal module of the terminal assembly shown in FIG. 4.
Figure 6:
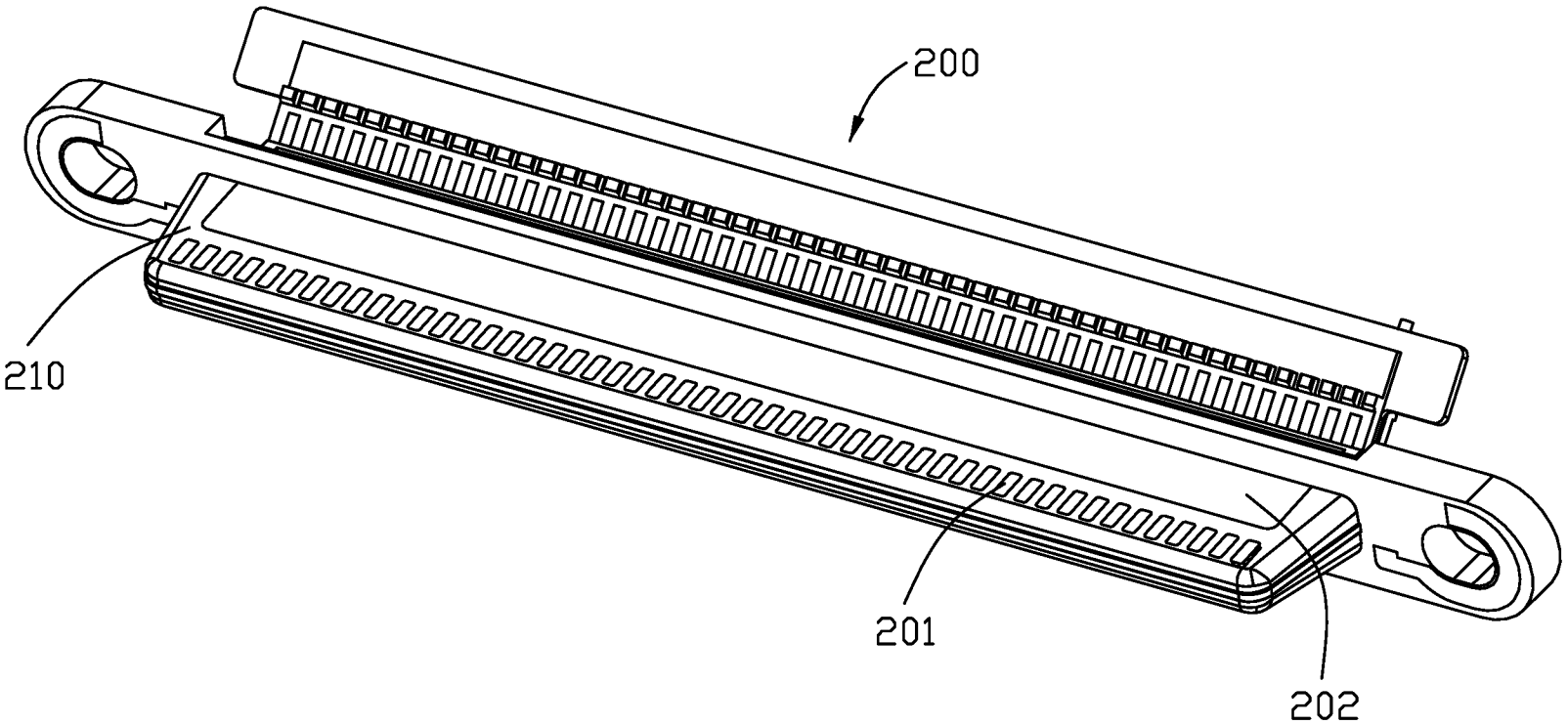
FIG. 6 is a perspective view of a complementary connector mating with the electrical connector showed in FIG. 1.

Further referring to FIGS. 4-6, the insulative housing 1 includes a rear wall 14 extending backwardly therefrom used for receiving the terminal assembly 3. The terminal assembly 3 includes a first terminal module 31, a second terminal module 32 and a third terminal module 33 sandwiched between the first terminal module 31 and the second terminal module 32. The first terminal module 31 includes a row of terminals 30 and a first insulative block or insulator 310 injected thereon wherein the first insulative block 310 forms a Z-shaped configuration in a side view. The second terminal module 32 includes a row of terminals 30 and a second insulative block or insulator 320 injected thereon wherein the second insulative block forms an L-shaped configuration in a side view. The first insulative block 310 and the second insulative block 320 includes respectively a pair of first engaging portions 3101 and a pair of second engaging portions 3201, at two opposite ends thereof. The first engaging portions 3101 and the second engaging portions 3201 are engaged together to clamp the third terminal module 33 therebetween.

From the functional point of view, the terminal assembly 3 can be categorized into a signal terminal group and a ground terminal group. The signal terminal group includes a plurality of differential pairs or differential pair signal terminals 303 and the ground terminal group includes a plurality of ground terminals 301. And the differential pairs 303 and the ground terminals are staggered along the elongate/transverse direction. The ground terminals/contacts further include at least a first ground terminal 301 arranged in line with the differential pair 303 in the elongate direction at front ends thereof, and at least a second ground terminal/contact 302 in line with the first ground terminal 301 in an up-to-down/front-to-back direction. The second ground terminal 302 is forwardly inserted into the insulative housing 1 and protrudes forward over the first ground terminal 301 in a front-to-back direction perpendicular to both the up-to-down direction and the elongate direction. Each of the first ground terminal 301 and the second ground terminal 302 includes a main body. The first ground terminal 301 and the second ground terminal 302 respectively includes a first contact portion 3010 and a second contact portion 3020 both extending from the main body and protruding into the receiving cavity 101, wherein the second contact portion 3020 protrudes forward over the first contact portion 3010. Each signal terminal of the differential pair 303 also includes a main body, and a third contact portion 3030 extending therefrom and protruding into the receiving cavity 101. The height of the third contact portion 3030 in the receiving cavity 101 is equal to the first contact portion 3010 while the height of the second contact portion 3020 in the receiving cavity 101 is different from the first contact portion 3010.

In the first embodiment of the invention, the differential pairs 303 and the at least a first ground terminal 301 combine into the terminals 30 both in the upper first terminal module 31 and in the lower second terminal module 32. And the terminal assembly 3 includes a upper row of said second ground terminals 302 and a lower row of said second ground terminals 302 respectively disposed on the first terminal module 31 and under the second terminal module 32, wherein each second ground terminal 302 corresponds to one first ground terminal 301 and the two ground terminals are received in one upper or lower terminal passageway respectively formed in the top wall 11 or the bottom wall 12 of the insulative housing 1. The upper second ground terminal 302 protrudes into the receiving cavity higher than the upper first second ground terminal 301, while the lower second ground terminal 302 protrudes into the receiving cavity lower than the lower first ground terminal 301.

It should be noted that, in the first embodiment of the invention, the ground terminal group of the terminal assembly 3 consists of said at least one first ground terminal 301 and said at least one second ground terminal 302, and the first contact portion 3010 and the second contact portion 3020 are respectively extending from the main body of the first ground terminal 301 and the main body of the second ground terminal 302. It should be understood that, in other embodiment, the ground terminal group also can be equipped with just one main body commonly connecting with said first contact portion 3010 and said second contact portion 3020, which can reach the same technological effect.

Figure 7:
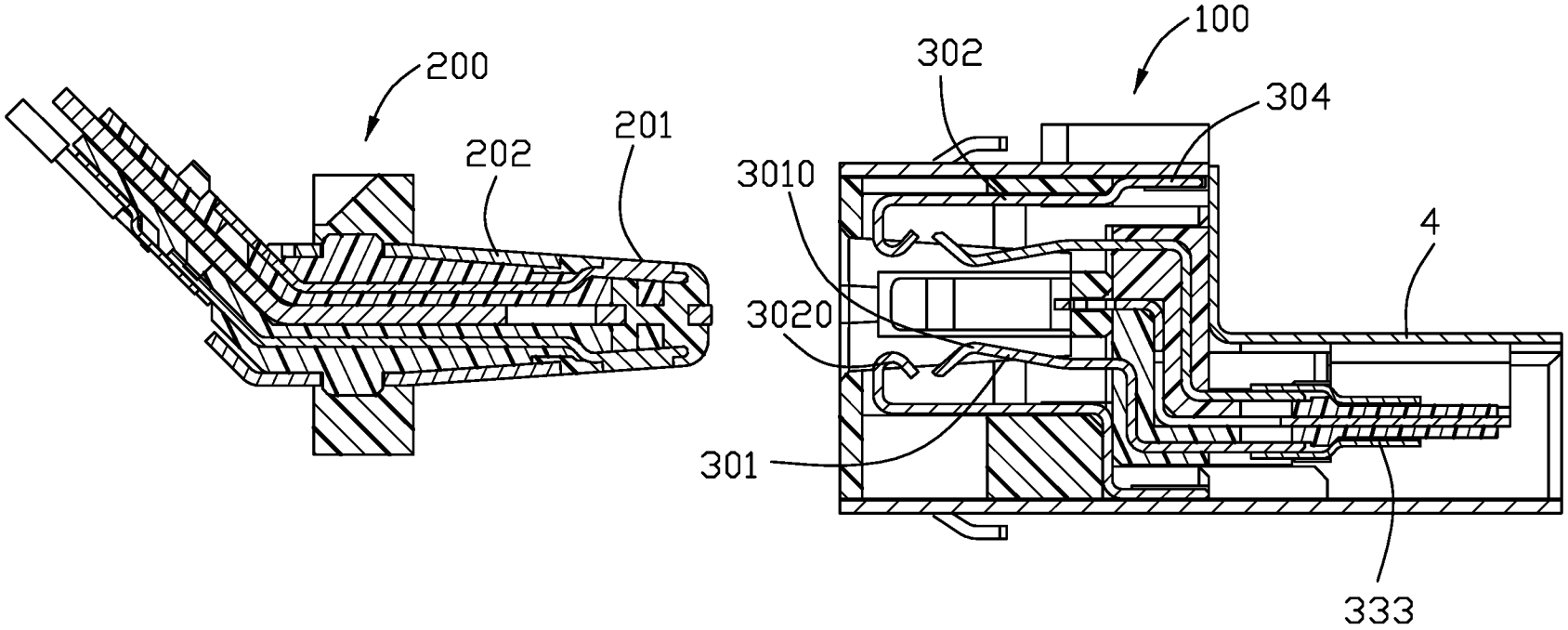
FIG. 7 is a cross section view of a combination between the electrical connector showed in FIG. 1 and the complementary connector therefore showed in FIG. 6.

Referring to FIGS. 4-5, the third terminal module 33 comprises a third insulative block or insulator 331 and a shielding member 332 retained therein wherein the shielding member roughly forms an L-shaped configuration in a side view, and two grounding bars 333 assembled outside the third insulative block 331. In this embodiment, the third insulative block 331 is integrally formed with the shielding member 332 via an insert-molding process and exposed upon two opposite surfaces thereof with a plurality of grooves to regulate the tail ends of the corresponding the terminals 301, 303. As shown in FIG. 7, the Z-shaped first insulative block 310 and the L-shaped second insulative block 320 are respectfully located by two opposite sides/surfaces of the shielding member 332. In addition, such a shielding member 332 further includes a pair of locking arms (not labeled) on two lateral sides to extend into the receiving cavity for engagement with the corresponding complementary connector 200. Each grounding bar 333 includes elongate body 3330 attached to one outside of the third insulative block 331, and a plurality of engaging arms 3332 extending from the elongate body 3330 and respectively contacting the main bodies of the first ground terminals 301, and a pair of soldering portions 3331 disposed at two opposite sides of the grounding bar 333 and windingly extending to have an engagement with a horizontal portion 3320 of the shielding member 332 by soldering. That is, the first ground terminals 301 get a complete electrical contact with the shielding member 332 via the ground bars 333. In this embodiment, the shielding member 332 forms a plurality of elastic arms (not labeled) extending forwardly into a mid-level of the receiving cavity to contact a corresponding shielding plate formed in a front end of the tongue of the complementary connector (illustrated later).

The main bodies of each row of second ground terminals 302 connect to each other at rear sides thereof to form a connection portion 304, thus commonly forming thereof another grounding bar along the longitudinal/transverse direction. The upper connection portion 304 is attached onto the top face of the first terminal module 31 and the lower connection portion 304 is attached onto the bottom face of the second terminal module 32. The electrical connector 100 also includes a cover 4 assembled in the back of and both the insulative housing 1 and the metal case 2, the cover 4 electrically contacting both the metal case 2 and at least a soldering piece 3325 of the shielding member 332 for a good anti-EMI (Electro-Magnetic Interference) effect. In this embodiment, the two connection portions 304 directly electrically contact the metal case 2.

Referring to FIGS. 6 and 7, according to the present embodiment of the invention, a complementary connector 200 mating with the electrical connector 100 is disclosed, comprising a tongue (portion) 210 matching up with the receiving cavity 101 of the electrical connector 100 and including an upper mating surface and a lower mating surface, and engaging terminals 201 partly exposed upon the two mating surfaces, and a shielding/grounding piece 202 disposed behind the exposed part of the engaging terminals 201. Notably, the engaging terminals 201 are also arranged with a plurality of grounding terminals and differential pair signal terminals alternately arranged with each other along the transverse direction for complying with the terminals of the electrical connector 100. When the electrical connector 100 and the complementary connector 200 are mated with each other, each of the first ground terminals 301 and the third differential pairs (terminals) 303 contacts the corresponding engaging terminal 201, and the second contact portions 302 contact the shielding piece 202, which improves the anti-EMI effect. It is noted that, the second terminals 302 are respectively disposed between the differential pairs 303, which is conducive to further improving the anti-EMI effect. From a technical viewpoint, during mating, on one hand the second ground terminal 302 of the electrical connector 100 firstly contact the (grounding) engaging terminals 201 of the complementary connector 200 before the differential pairs 303 and the first ground terminals 301 contact the corresponding engaging terminals 201. This arrangement results in a desired "grounding first" and "signal second" way during mating. On the other hand, the second ground terminals 302 of the electrical connector 100 may contact the shielding/grounding piece 202 during fully mated, thus resulting in an EMI shielding path. In brief, the second ground terminals 302 have dual functions respectively in the initial mating and the full mating. Notably, the complementary connector 200 further includes a shielding plate (not labeled) in the mid-level with a front end exposed beyond the tongue 210 so as to contact the elastic arms (not labeled) of the shielding member 332 of the electrical connector 100 during full mating with reference to FIG. 7.

Figure 8:
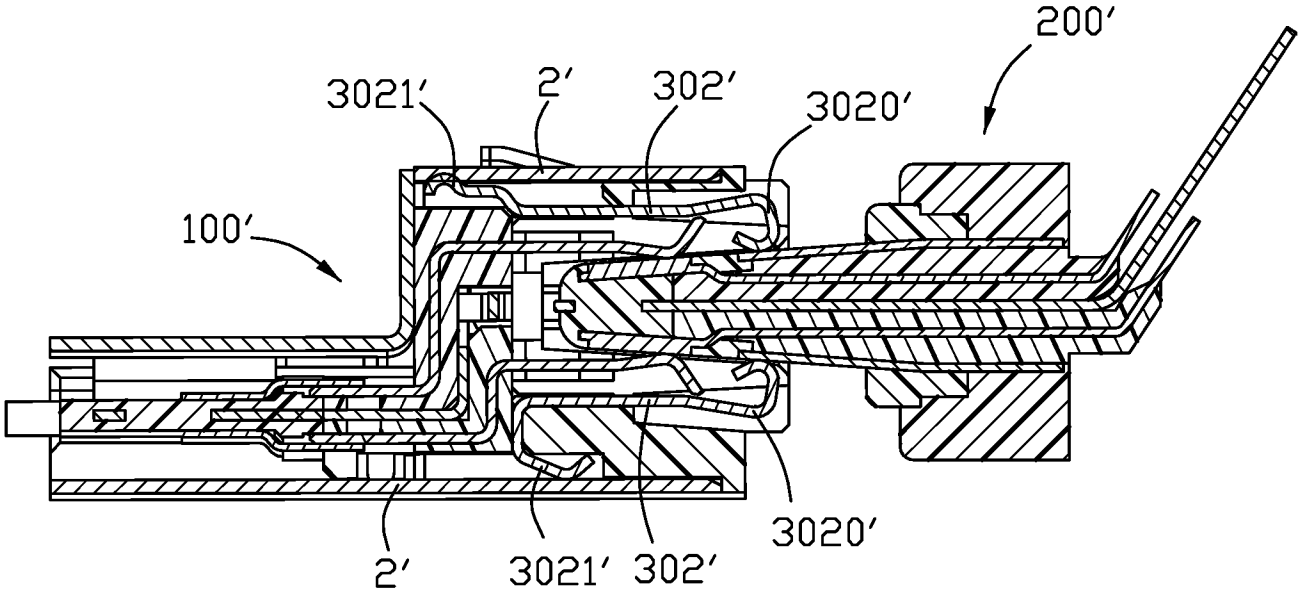
FIG. 8 is a cross section view of a combination between another electrical connector according to a second embodiment of the present invention and a complementary connector therefore.

Referring to FIG. 8, according to a second embodiment of the invention, an electrical connector 100' mating with a complementary connector 200' is disclosed, comprising a metal case 2' and a second ground terminal 302' which has a second contact portion 3020'. Differently, the second ground terminal 302' additionally equips with a spring contact portion 3021' integrally extending from a main body thereof until flexibly abutting against the metal case 2'. It should be understood that, there is a more stable electrical and mechanical connection between the second ground terminal 302' and the metal case 2' via the spring contact portion 3021', and the second ground terminal 302' don't need be soldered to the metal case 2' for a better engagement, which may be operated in the first embodiment of the invention. Moreover, the second ground terminal 302' is easily fabricated.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A electrical connector comprising:

an elongate insulative housing including a top wall, a bottom wall opposite to each other and a pair of end walls respectively connecting two ends thereof, and a receiving cavity surrounded thereby; a terminal assembly received in the top wall and the bottom wall respectively, and stacked in an up-to-down direction; and a metal case enclosing the insulative housing;

wherein the terminal assembly includes a signal terminal group, and a ground terminal group including a first contact portion and a second contact portion, wherein the first contact portion and the second contact portion are arranged in a front-to-back direction perpendicular to both the up-to-down direction and an elongate direction, and respectively protruding into the receiving cavity; wherein the signal terminal group includes a third contact portion protruding into the receiving cavity, and a front end of said first contact portion is in line with a front end of the third contact portion in the elongate direction but the second contact portion protrudes forward over the first contact portion in the front-to-back direction; wherein each of the signal terminal group or the ground terminal group includes a main body from which the corresponding first contact portion, second contact portion or third contact portion extends, wherein the first contact portion in the receiving cavity is higher than the second contact portion when protruding upwardly into the receiving cavity, but lower than the second contact portion when protruding downwardly into the receiving cavity, while the second contact portion in the receiving cavity is in line with the third contact portion disregarding whether the second contact portion protrudes upwardly or downwardly; wherein the ground terminal group includes a first ground terminal containing said first contact portion and a second ground terminal containing said second contact portion, and the first ground terminal and the second ground terminal commonly received in one terminal passageway defined by the top wall or the bottom wall; wherein the second ground terminal is either equipped with a spring contact portion extending from the main body for flexibly abutting against the metal case, or the main body of the second ground terminal directly electrically contacts with the metal case.

2. The electrical connector as described in claim 1, wherein the first contact portion and the second contact portion commonly extend from a same one main body into the receiving cavity.

3. The electrical connector as described in claim 1, wherein the electrical connector includes a shielding member between the top wall and the bottom wall, and a grounding bar electrically connecting to the shielding, wherein the grounding bar contacts the first ground terminal.

4. An electrical connector assembly, comprising:

a receptacle connector including an insulative housing having a receiving cavity, and a terminal assembly retained in the insulative housing and stacked in an up-to-down direction, and a metal case enclosing the insulative housing; and a plug connector matching up with said receptacle connector, including a tongue received in said receiving cavity and defining two opposite mating surfaces in the up-to-down direction, and engaging terminals partly exposed upon at least one of said two opposite mating surfaces, and a shielding piece disposed behind the exposed part of said at least an engaging terminal;

wherein the terminal assembly includes a signal terminal group, and a ground terminal group including a first contact portion and a second contact portion, wherein the first contact portion and the second contact portion are arranged in a front-to-back direction perpendicular to the up-to-down direction and respectively protruding into the receiving cavity, wherein the second contact portion engages with said shielding piece of said plug connector; wherein the signal terminal group includes a third contact portion protruding into the receiving cavity, and a front end of said first contact portion is in line with a front end of the third contact portion in the elongate direction but the second contact portion protrudes forward over the first contact portion in the front-to-back direction, wherein the first contact portion and the third contact portion respectively connect to the corresponding engaging terminals of said plug connector.

5. The electrical connector as described in claim 4, wherein the ground terminal group includes a first ground terminal containing said first contact portion and a second ground terminal containing said second contact portion, and the first ground terminal and the second ground terminal commonly received in one terminal passageway defined by said insulative housing, wherein said ground terminal group includes a plurality of said second ground terminals each of which has a main body, and said main bodies of said second ground terminals connect to each other at rear sides thereof to form a connection portion, and each said second ground terminal is equipped with a spring contact portion extending from said connection portion for flexibly abutting against the metal case.

6. An electrical connector assembly comprising:

a receptacle connector including a first housing defining a receiving cavity;

a plurality of terminals disposed in the housing and arranged with one another in one row along a transverse direction, said terminals including grounding terminals and differential pair signal terminals alternately arranged with each other along said transverse direction;

a metallic grounding bar unitarily having a plurality of grounding contacts disposed in the housing around an exterior face of the housing, each of said grounding contacts forming a contacting end aligned with and located in front of the corresponding grounding terminal along a front-to-back direction perpendicular to said transverse direction;

and a plug connector including:

a tongue portion adapted to be mated within the receiving cavity and including a plurality of engaging terminals exposed upon a front region of the tongue portion, said engaging terminals including a plurality of engaging differential pair signal terminals and a plurality of engaging grounding terminals alternately arranged with each other along the transverse direction; and a metallic shielding/grounding piece position upon a rear region of the tongue portion; wherein during initial mating between the receptacle connector and the plug connector, the grounding contacts of the receptacle connector contact the corresponding engaging grounding terminals, respectively, before the differential pair signal terminals of the receptacle connector contact the corresponding engaging differential pair signal terminals of the plug connector; during full mating between the receptacle connector and the plug connector, the grounding contacts of the receptacle connector contact the shielding/grounding piece, and the differential pair signal terminals of the receptacle connector respectively contact the corresponding engaging differential pair signal terminals of the plug connector, and the grounding terminals of the receptacle connector respectively contact the corresponding engaging grounding terminals of the plug connector.

7. The electrical connector assembly as claimed in claim 6, wherein said receptacle connector includes a metallic shell enclosing said housing, and said grounding bar contacts said metallic shell.

8. The electrical connector assembly as claimed in claim 6, wherein the grounding contacts are aligned with the corresponding grounding terminals, respectively, in a vertical direction perpendicular to both said transverse direction and said front-to-back direction.

9. The electrical connector assembly as claimed in claim 6, wherein the grounding contacts extends rearwardly beyond the receiving cavity in said front-to-back direction.

10. The electrical connector assembly as claimed in claim 6, wherein said receptacle connector further includes a metallic shielding member with elastic arms extending into the receiving cavity to contact a shielding plate formed in the tongue portion of the plug connector during full mating.

11. The electrical connector assembly 10, wherein another grounding bar connects to the shielding member with corresponding engaging arms contacting tails of the corresponding grounding terminals, respectively.

12. The electrical connector assembly as claimed in claim 10, wherein said shielding member further includes a pair of locking arms extending into two opposite lateral sides of the receiving cavity.

13. The electrical connector assembly as claimed 10, wherein said receptacle connector includes opposite first and second terminal modules sandwiching said shielding member therebetween, and each of said terminal module includes one row of said terminals embedded within an insulator via an insert-molding process.

14. The electrical connector assembly as claimed in claim 13, wherein another insulator is formed on the shielding member via another insert-molding process and exposed upon two opposite surfaces of the shielding member with corresponding grooves therein so as to regulate tail ends of the corresponding terminals.

15. The electrical connector assembly as claimed in claim 13, wherein the first terminal module includes a first insulative block forming a Z-shaped configuration in a side view, the second terminal module includes a second insulative block forming an L-shaped configuration in said side view, and said shielding member forms another L-shaped configuration in said side view.

* * * * *